United States Patent [19]

Lonati

[11] 4,226,096

[45] Oct. 7, 1980

[54] PATTERN DRUM CONTROL DEVICE IN A CIRCULAR KNITTING MACHINE

[75] Inventor: Francesco Lonati, Brescia, Italy

[73] Assignee: Costruzioni Meccaniche Lonati S.p.A., Brescia, Italy

[21] Appl. No.: 21,535

[22] Filed: Mar. 19, 1979

[30] Foreign Application Priority Data

Mar. 24, 1978 [IT] Italy ..... 21613 A/78

[51] Int. Cl.[2] ..... D04B 15/74

[52] U.S. Cl. ..... 66/224; 66/237

[58] Field of Search ..... 66/224, 225, 227, 237

[56] References Cited

U.S. PATENT DOCUMENTS

| | | | |
|---|---|---|---|
| 1,784,186 | 12/1930 | Howie | 66/224 X |
| 2,255,068 | 9/1941 | Lawson et al. | 66/237 X |
| 2,317,268 | 4/1943 | Green | 66/224 X |
| 2,460,487 | 2/1949 | Bristow | 66/225 X |
| 2,927,447 | 3/1960 | Mahler | 66/237 X |
| 3,093,987 | 6/1963 | Zahrádka et al. | 66/224 X |
| 3,380,265 | 4/1968 | Peberdy | 66/224 X |
| 3,766,753 | 10/1973 | Schnurrer | 66/224 X |
| 3,835,668 | 9/1974 | Schiebel et al. | 66/224 X |

FOREIGN PATENT DOCUMENTS

| | | | |
|---|---|---|---|
| 1065126 | 9/1959 | Fed. Rep. of Germany | 66/224 |
| 466043 | 5/1937 | United Kingdom | 66/224 |

*Primary Examiner*—Wm. Carter Reynolds

*Attorney, Agent, or Firm*—Guido Modiano; Albert Josif

[57] ABSTRACT

For stepwise advancing a pattern drum in a circular knitting machine there is provided a device comprising a peripheral tooth formation on the pattern drum, a pawl capable of engaging the tooth formation and pivotally supported on a support which is caused to swing at each revolution of the needle cylinder under the action of a cam rigid with the needle cylinder. The cam has a first radially increasing part extending preferably for a half of a circle, a following second radially increasing part considerably steeper than the first part, and a progressively radially decreasing part. The cam causes the pawl to advance the pattern drum by two steps. When the pattern drum is to be advanced by a single step the pawl is disengaged from the tooth formation by an angle lever which is controlled by control pegs arranged on the pattern drum according to a control pattern.

5 Claims, 9 Drawing Figures

PATTERN DRUM CONTROL DEVICE IN A CIRCULAR KNITTING MACHINE

BACKGROUND OF THE INVENTION

This invention relates to a device for controlling the advance movement of the pattern selection drums or disks in a circular knitting machine.

Reference will be made hereinbelow exclusively to pattern drums, but it will be appreciated that the invention is also applicable in machines equipped with pattern selection devices comprising plural stacked pattern disks or wheels.

As is known, the pattern drums have a plurality of pegs or teeth arranged on the side surface thereof, in accordance with the pattern to be obtained on the final knitted product. The drums are caused to advance stepwise, thereby presenting for each knitting course a given peg or tooth arrangement, which arrangement is not required to be a different one for each course. The pegs interfere with corresponding jack selecting levers to move such levers closer to the needle cylinder (or to the lower needle cylinder, in the instance of a double cylinder machine), thereby to select, for each knitting course, those needles which are to pick up the yarn or thread from the yarn feed wherewith the drum is associated.

The advance movement of each drum must be effected at a well defined time, so that a new arrangement of pegs and levers will coincide with a fresh knitting course. For this purpose, an annular cam is made rigid with the needle cylinder which has a symmetrically walled depression at a given angular position and is followed by a square bracket lug on a support which is freely pivoted under each drum coaxially thereto. To the support, a pawl is pivoted which cooperates with a peripheral tooth formation of the drum, for advancing it. The depth of the depression in the radial direction is such as to allow, at each revolution of the cylinder, an oscillation of swing movement of the support adequate for resulting in a two-tooth advance movement of the drum, i.e. a two-step advance movement. In practice, however, the advance movement normally utilized will be a single step, and the two-step advance movement will only be performed to bring the drum back to the starting or initial conditions upon completion of one or more repeated patterns. In fact, since it is not always possible to make the width (as expressed in terms of knitting courses) of a pattern coincide with the total number of vertical rows of pegs in a drum or with a submultiple of that number (and accordingly, with the total number of advance teeth or submultiple thereof), it is at a certain moment necessary to cause the drum to advance one or more times through two-step cycles, such that at the end of the pattern (or of a finite number of repeated patterns) it has completed one revolution exactly.

In conventional techniques, the one-step advance, rather than the two-step one, is accomplished by blocking the pawl support during the return stroke at a position whereby the next advance movement, as controlled by the cam, implies for the pawl a stroke length corresponding to a single tooth of the drum, rather than two such teeth. In this case, the pawl engages the tooth directly behind the one engaged during the preceding advance movement, and the square bracket lug of the support does not follow the cam depression down to the bottom of it but remains temporarily detached therefrom, to undergo the cam effect during the second half of the depression upward slope.

To select the one or two-step advance of the drum a lever system is provided which comprises a stop lever provided with a stop or detent tooth which can be positioned in the return path of the support such as to interfere with an abutment surface thereof, and a control lever acting on the stop lever and having one end engageable with pegs arranged on the drum itself. The presence or absence of pegs determines the positions of the two levers, and consequently, the stopping or non-stopping of the support halfway through its return stroke, depending on whether the next advance movement is to be a one-step or two-step one.

However, in a device of this type, the start of the two-step advance movement is phase-advanced with respect to the one-step movement, thereby it cannot occur in phase therewith. This fact may result, on some articles, in pattern faults due to the phase-advanced variation of the peg arrangement with respect to that required for completing the knitting course being formed. To make that phase-advance less felt, one must retard as much as possible the start of the advance movement, i.e. increase the steepness angle of the first part of the cam upward portion, which controls the first phase of the two-step advance movement. However, this fact involves considerable accelerations in the drum and thus the necessity of providing powerful brakes to prevent the drum from being flung beyond the proper position. On the other hand, the provision of powerful brakes implies greater effort for the advance movement and, accordingly, greater wear of the components providing said advance movement and a frequent replacement of the brakes.

Another drawback of these conventional devices resides in the shocks produced during the return stroke of the support, when it strikes against the stop tooth of the stop lever, in normal operating conditions. In addition to generating noise, such shocks may damage the various mechanical components, and even affect the accuracy of the drum advance movement.

Moreover, the structure of the known devices is a comparatively complex and bulky one owing to the provision of two levers, respectively a stop lever and control lever. In addition thereto, the pawl support must be shaped such as to contact the stop lever, which increases its volume and mass.

SUMMARY OF THE INVENTION

This invention sets out to overcome the shortcomings and limitations of conventional devices for the advance movement of the pattern selection drums, by providing a device which allows faultless knitted products to be obtained independently of whether the drum advance movement is a one-step or two-step one, and moreover such as to induce limited accelerations in the various mechanical components of the device, whereby the use of powerful brakes becomes unnecessary.

A further object of this invention is to provide a device as above, which is of more economical construction than conventional devices and has a longer life by reason of the reduced wear of its components.

These objects are achieved in this invention by a device for controlling the advance movement of the pattern selection drums, wheels or disks in a circular knitting machine, in which the drums, wheels or disks act on a plurality of superposed jack selecting levers, comprising a pawl in engagement with a peripheral tooth formation of a respective selection drum or set of stacked selection wheels or disks for the advance movement thereof, and pivoted on a support enabled to oscillate about an axis coincident with the axis of said selection drum or set of stacked wheels or disks, said support having one end in engagement with an annular cam rigid with the needle cylinder, respectively the lower needle cylinder, and having a depression of such depth as to impart to said support, for each revolution of the needle cylinder, an oscillation capable of producing a two-tooth advance movement of said peripheral tooth formation, the device being characterized in that said depression has a first part thereof extending over at least one quarter of a circle, preferably over half a circle, and adapted for effecting a one-tooth advance movement of said tooth formation, and a second part having an appreciably greater inclination angle, following said first part, and being adapted for effecting a further one-tooth advance movement of said tooth formation, and in that said pawl is detachable from said tooth formation under control over the second half of the return stroke thereof, the selection drum or set of stacked wheels or disks having at least two adjacent vertical rows of pegs or teeth thereon to consecutively act on the jack selecting levers during a two-tooth advance movement of said tooth formation.

With this invention, instead of reducing the angular width of the first part of the depression in order to decrease the advance of the selection lever switch control in the instance of a two-step advance movement of the selection drums, such angular width is extended to occupy preferably a half circle. In this manner, not only a smaller acceleration is achieved along the first part of the advance movement, and thus the elimination of powerful brakes, but also, by arranging two equal adjacent vertical rows of pegs on the drum, the effect of not advancing in any way the variation of the selection lever arrangement when the advance movement is a two-step one, said variation being accomplished only during the second part of the cam, namely when that variation occurs in any case also when the advance movement is of one-step. Thus, any fault in the fabric pattern is effectively and reliably prevented. It should be further noted that the raising of the pawl during the second half of its stroke, when the next advance movement is to be a one-step one, avoids all shocks of the support against stop members, and appreciably simplifies all the device structure by virtue of the stop lever being eliminated.

BRIEF DESCRIPTION OF THE DRAWINGS

Further features and advantages of the invention will become more clearly apparent from the following detailed description of a preferred embodiment thereof, given herein by way of example only and illustrated in the accompanying drawings, where.

DESCRIPTION OF THE PREFERRED EMBODIMENT

Figure 3:
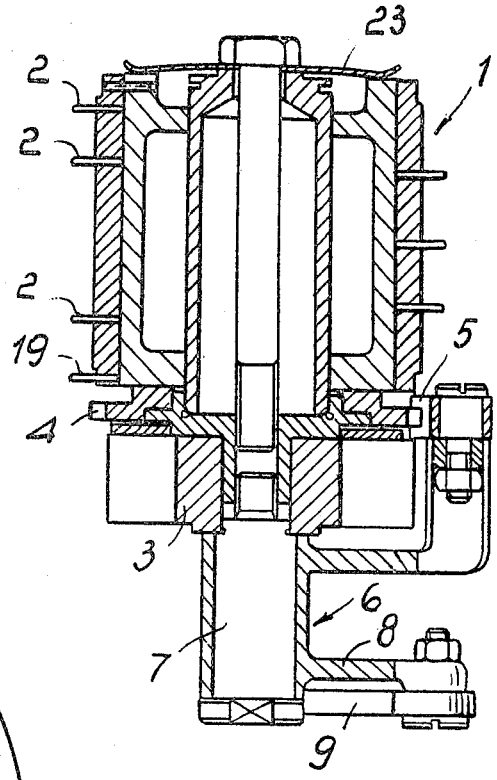
FIG. 3 is an axial sectional view through a selection drum and the advance movement device, taken along the line III—III of FIG. 1.
Figure 1:
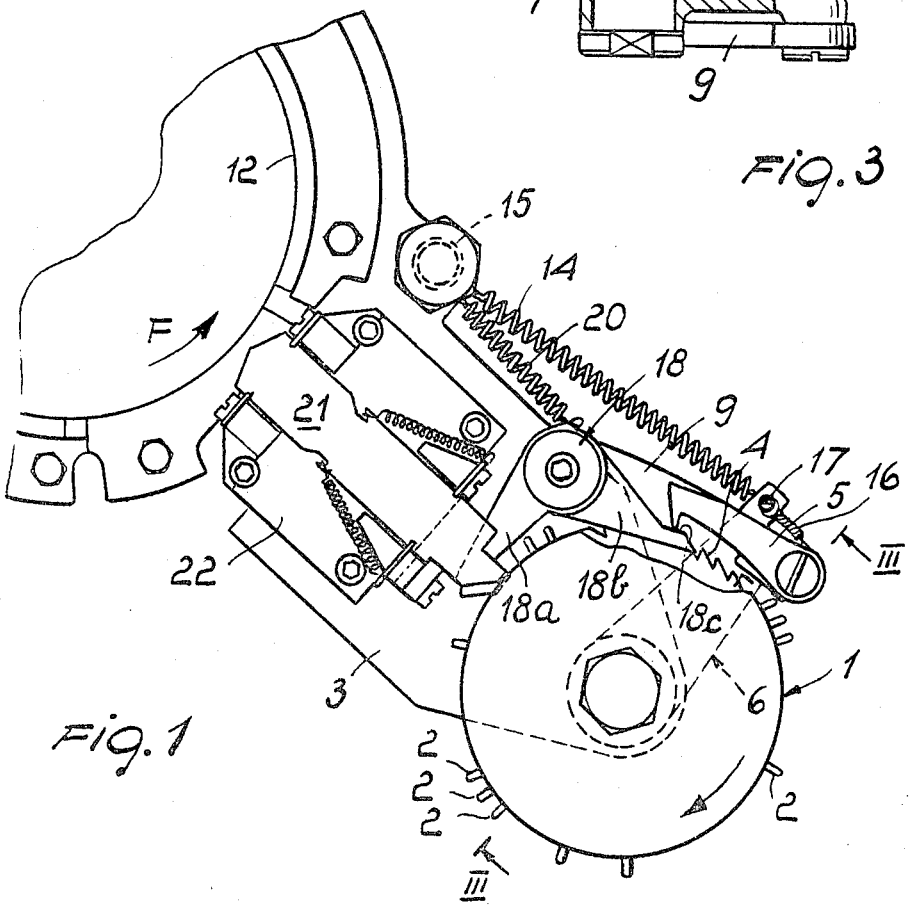
FIG. 1 is a top view of a device according to the invention as applied to a double cylinder circular knitting machine.
Figure 2:
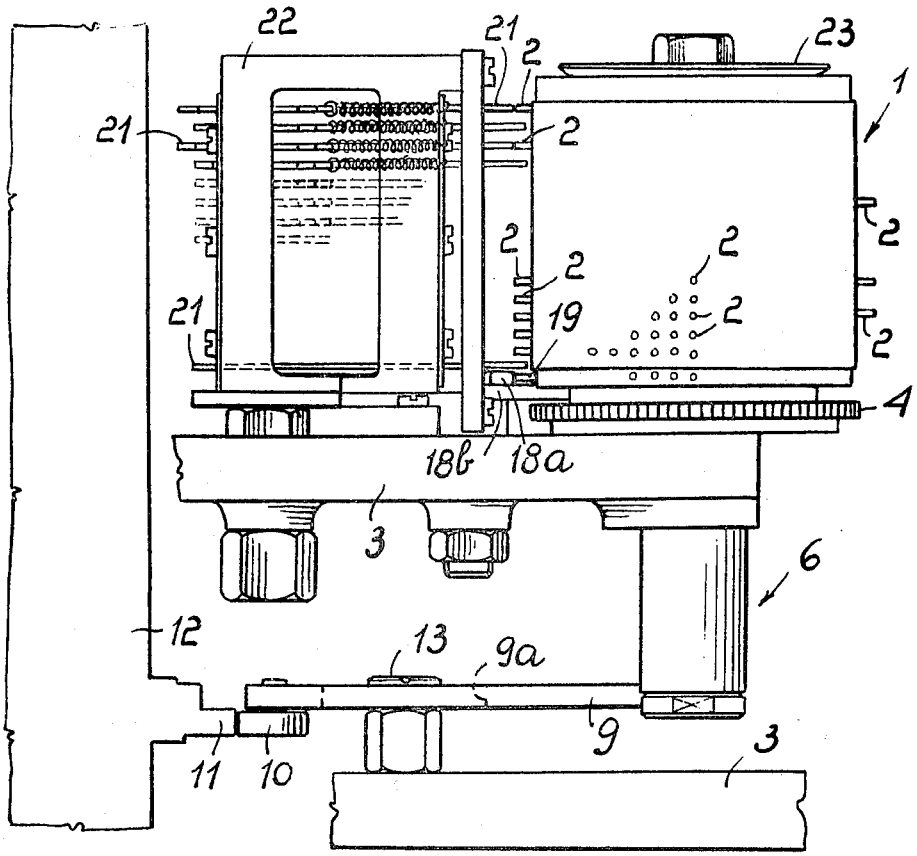
FIG. 2 is a side view of the device of FIG. 1.
Figure 4:
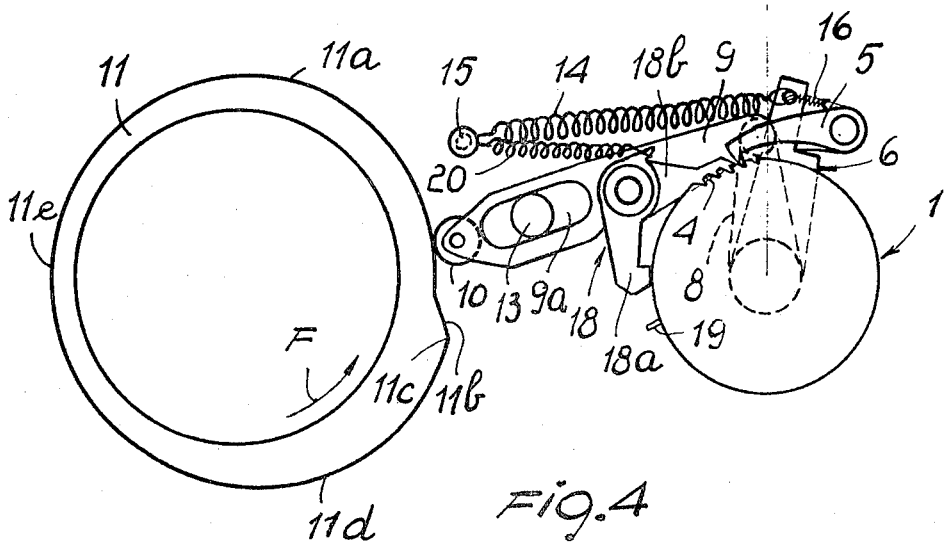
FIGS. 4,5,6 and 7 show schematically the operation of the device in the instance of a one-step advance movement.
Figure 5:
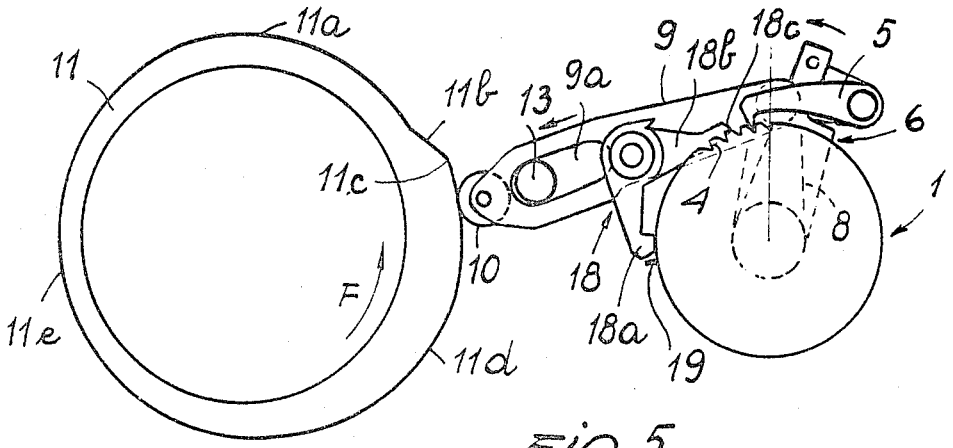

With reference first to FIGS. 1,2 and 3 of the drawings, there is indicated at 1 a pattern drum or other patterning member which is provided, on its side surface and in a manner known per se, with a plurality of pegs 2 arranged in accordance with the pattern to be obtained in the final knitted product. The drum 1 is carried rotatably in the frame 3 of the machine and has a peripheral tooth formation 4 at the bottom, which has a number of teeth equal to the number of vertical rows of pegs 2 of the drum 1 and is engaged by a pawl 5 adapted for advancing the drum by one or two teeth at a time.

The pawl 5 is journalled, along an axis parallel to that of the drum 1, to a support 6, in turn carried pivotally about a pin 7 attached to the frame 3 coaxially with the drum 1. The support 6 is thus enabled to oscillate about the axis of the drum 1 independently of the latter.

The support 6 has at the bottom a radial arm 8 whereto one end of a lever 9 is journalled the other end whereof carries an idle roller 10. This roller is intended for rolling along the peripheral contour or profile of an annular cam 11, mounted rigid with the needle cylinder 12 (in this instance, with the lower needle cylinder), the direction of rotation whereof is indicated by the arrow F. The cam follower lever 9 has a guide slot 9*a*, which is penetrated by a fixed guide pin 13 such that the movement of the lever 9, as determined by the action of the cam 11, is substantially radial with respect to the cylinder 12.

A spring 14 stretched between a fixed pin 15 and the free end of the arm 8, maintains the contact between the roller 10 and cam 11, while a spring 16 stretched between a pin 17 of the support 6 and pawl 5 tends to maintain the latter in contact with the peripheral tooth formation 4.

The annular cam 11 has a peripheral profile having in the direction of rotation a first outside sloping part 11*a* which extends over at least one quarter of a circle, preferably over a half circle, followed by a second outside sloping part 11*b*, of appreciably steeper inclination angle, which terminates at the topmost point 11*c* of the cam and is followed by an inside sloping part 11*d*. The radial increment of each part 11*a*, 11*b* is substantially equal to one half the difference between the topmost point 11*c* of the cam and the lowermost point 11*e*, that difference being equal to a displacement of two teeth by the pawl 5 along the tooth formation 4. The downward part 11*d* may slope progressively downward to the lowermost point 11*e*, thus exhibiting a slope angle which is substantially twice that of the part 11*a* shown in the drawings, or alternatively may have a greater inclination angle and be, for example, connected to the start of the part 11*a* by a circular part or section.

The device according to the invention further comprises a control lever 18, journalled to the frame 3 along an axis parallel to the axis of the drum 1 and of substantially square bracket configuration. An arm 18*a* of the lever 18 lies in the plane of the last row of pegs 19 of the drum 1, not intended for acting on any selection levers, and has one end shaped for sliding on said pegs, which are arranged in accordance with a determined program, as will be explained hereinafter. A spring 20 maintains the end of the arm 18*a* in contact with the pegs 19 or with the drum 1 wherein the pegs 19 are not present.

The other arm 18*b* of the lever 18 lies in a plane different from that of the arm 18*a* and tooth formation 4, and has one end provided with an outer surface 18*c* for sliding engagement with the pawl 5, said surface having a front or leading portion which has substantially the same inclination as the front flank of the teeth of the tooth formation 4. The angle between the arms 18*a* and 18*b*, considering the position of the pivot point for the lever 18, is such that when no control peg 19 is present and the end of the arm 18*a* contacts the side surface of the drum 1, the outer surface 18*c* is positioned, with respect to the axis of the drum, at a greater distance than that of the tops of the teeth in the tooth formation 4; viceversa, when the end of the arm 18*a* engages with a control peg 19, the outer surface 18*c* is closer to the axis of the drum than to the roots of the teeth in the tooth formation 4.

In the drawings, jack selecting levers 21, of conventional design, are also shown which are movable in a support or carrier 22 along a radial direction with respect to the cylinder 12 under the action of the pegs 2, in a manner known per se. At 23, there is indicated a cup spring effective to brake slightly the drum 1 with respect to its fixed pivot pin.

In regard to the operation of the device described above, reference will be made to FIGS. 4 to 9.

In normal operating conditions, when the drum 1 is to be caused to advance one step at a time, the angle lever 18 is not subjected to the action of any pegs 19 and its end 18*b* projects beyond the tops of the teeth in the tooth formation 4. The one step advance movement of the drum 1 is obtained by means of the second upward part 11*b* of the cam 11 (see FIGS. 4 and 5), which, via the roller 10, causes an outward displacement of the lever 9 to occur, and a partial rotation of the support 6 and pawl 5, equivalent to one tooth.

Figure 6:
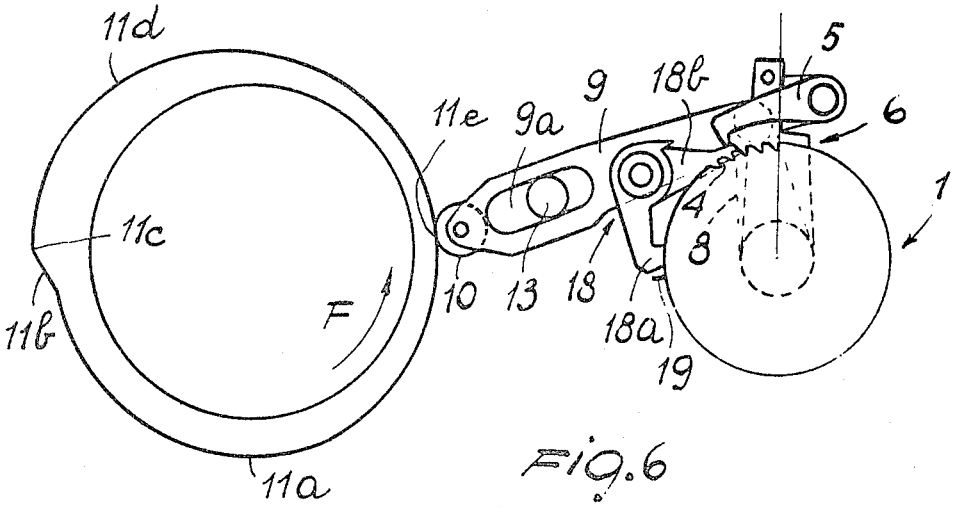

Subsequently thereto, with the cam 11 continuing its rotation, the roller 10 is caused to slide along the downward part 11*d*, which results in the lever 9 being retracted and the pawl 5 completing its return stroke. The position of the lever 18 and its outer surface 18*c*, however, is such as to remove the tip of the pawl 5 from the teeth of the tooth formation 4 upon the pawl reaching the middle of its return stroke, thereby the pawl proceeds along the second half of its return stroke on the profile or contour 18*c*, as shown in FIG. 6.

Figure 7:
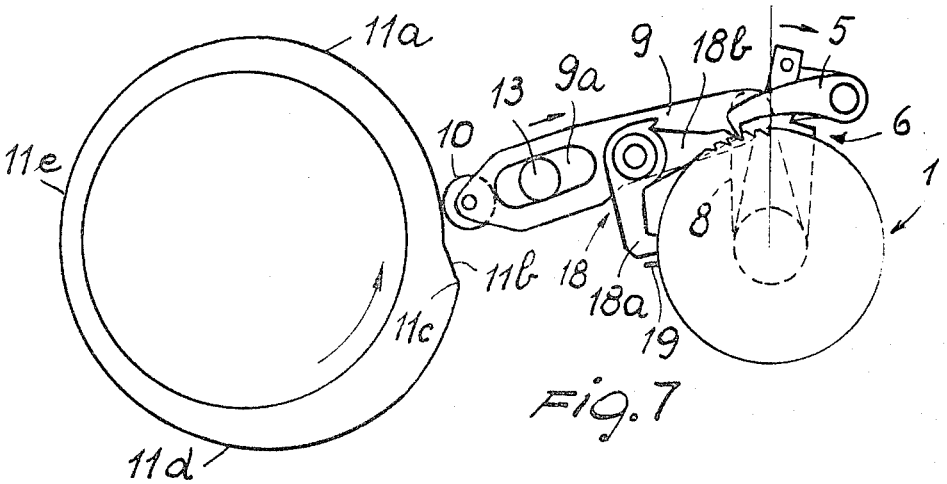

Then the cam 11, in continuing its rotational movement, brings the roller 10 to the first upward part 11*a* which, while involving displacement of the pawl 5 in the positive direction of advance of the drum 1, has no effect on the drum itself, since during that first part, the forward stroke of the pawl 5 occurs on the profile 18*c*, without engaging any of the teeth in the tooth formation 4. At the end of the part or portion 11*a*, the pawl has just reached behind the tooth adjacent the one previously made to advance, as shown in FIG. 7, thereby the successive upward part 11*b* of the cam 11 provides a one step positive advance movement of the drum in the manner already described, and so on.

Figure 8:
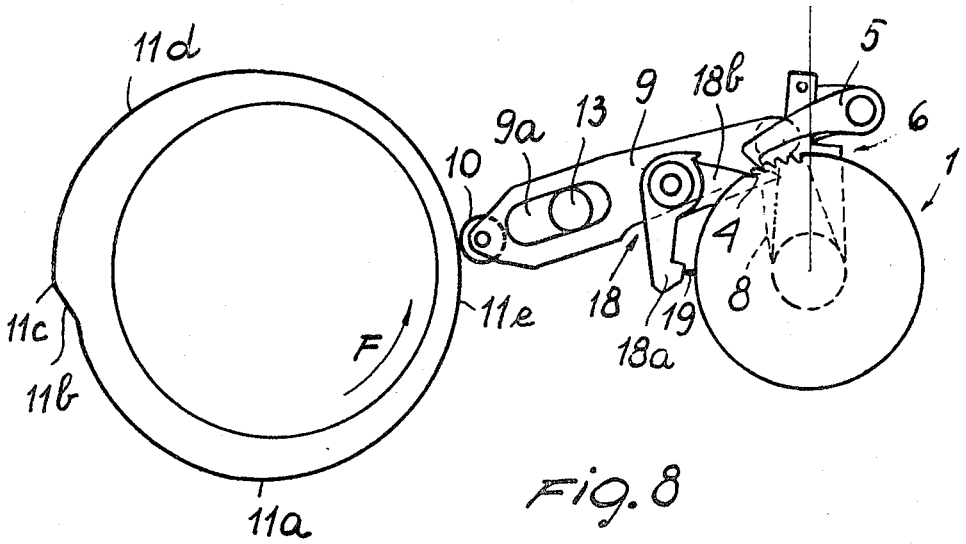
FIGS. 8 and 9 show schematically the operation of the device in the instance of a two-step advance movement.
Figure 9:
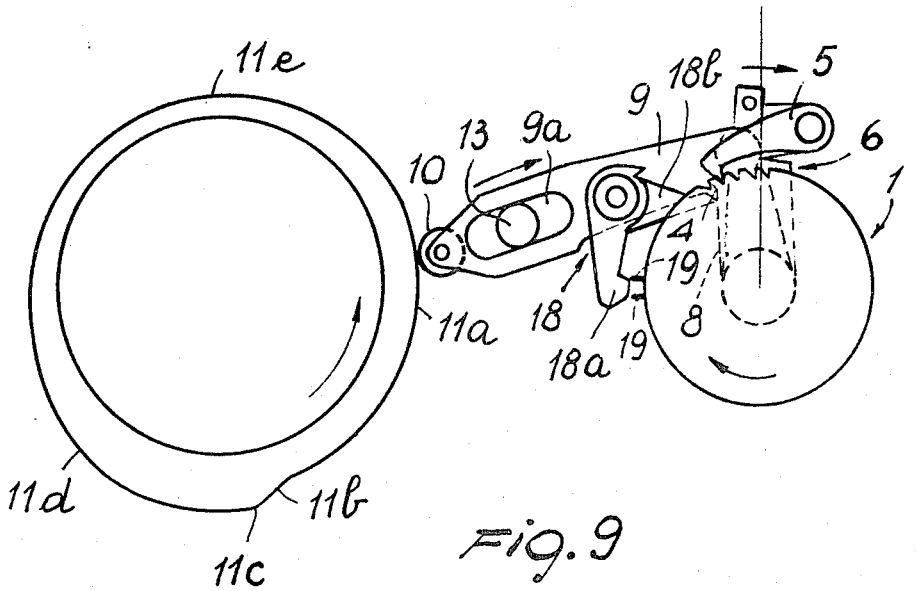

By contrast, when the advance movement of the drum is to be a two-step one, a peg 19 causes the lever 18 to rotate such that the profile 18*c* moves to the inside of the envelope line of the roots of the teeth in the tooth formation 4, as shown in FIGS. 8 and 9, whereby the whole return stroke of the pawl 5 is performed in contact with the tooth formation 4, and upon reaching the lowermost point 11*e* of the cam 11, the pawl is still in contact with the tooth formation (FIG. 8). In this manner, the first part 11*a* of the cam 11 also becomes active as relates to the advance movement of the drum 1, because it involves displacement (albeit a slow one) of the drum through a first step (FIG. 9), said displacement being then completed by the part 11*b* as relates the second step. The lever 18 will be then enabled to either return or not to its original position, depending on the arrangement of the pegs 19, whereafter either of the operations described hereinabove will be repeated.

According to the invention, the slow advance movement of the drum under the effect of the first upward part 11*a* of the cam 11 is rendered ineffective for selecting purposes by arranging a vertical row of pegs 2, equal to the preceding one, whereby throughout that slow advance movement there occurs no change in the arrangement of the selecting levers; thus, the slow advance movement only results in a one step gain towards restoring the initial conditions of the drum upon completion of the pattern and in a reduction of the accelerations involved. It will be appreciated that, owing to the first step having no effect on the selection, even in the instance of a two-step movement of the drum, the selection control is still issued at the same time instant as with the one-step advance movement, namely without advancing it in time, thus causing no fault in the product.

Obviously there will be two adjacent equal vertical rows of pegs or teeth 2 on the pattern drum 1 for controlling the selecting levers 21 each time a two-tooth advance movement of the pattern drum 1 is provided.

It will be noted that the device has a simpler construction than conventional devices; furthermore, the moving masses in the inventive device are of moderate magnitude, which makes the device according to this invention specially suitable for use in high speed machines.

The invention as described herein is susceptible to many modifications and variations falling within the scope of the appended claims. Thus, for example, the downward part 11*d* of the cam 11 could be of different shape, as already mentioned, and the first upward part 11*a* could extend over more than a half circle. Naturally, the positive advance movement control for the drum 1 could be derived, rather than from raising parts of the cam 11, from lowering ones, by arranging the actuating assembly at a mirror-image position opposite a plane containing the axis of the needle cylinder and the axis of the drum. The cam 11 would then have a peripheral profile or contour mating the one shown in the drawings. Finally, it will be appreciated that the device described above may be equally applied to double cylinder circular knitting machines and cylinder and dial machines, as well as, if required, single cylinder machines.

I claim:

1. A device for controlling the advance movement of a patterning member, like a pattern drum or a number of superposed pattern wheels or disks, in a circular knitting machine having at least one needle cylinder and jack-selecting levers operated by pegs or teeth of said patterning member, comprising a peripheral tooth formation on said patterning member, a pawl for engagement with said tooth formation to cause stepwise advancement thereof about an axis of said patterning member, a support pivotable about said axis of said patterning member and pivotally supporting said pawl, an annular cam rigid with said at least one needle cylinder, a cam follower lever between said annular cam and said support, said cam follower lever being pivotally connected to said support, said cam having a peripheral profile capable of imparting to said cam follower lever and to said support a to-and-fro movement causing said pawl to perform a forward and a return stroke capable of producing a two-tooth advance movement of said peripheral tooth formation at each revolution of said at least one needle cylinder, wherein said profile comprises a first part extending over at least one quarter of a circle, preferably over half a circle, and adapted to cause a one-tooth advance movement of said tooth formation, and a second part having an appreciably greater inclination than said first part and following said first part, said second part being adapted to cause a further one-tooth advance movement of said tooth formation, and wherein said device further comprises means for detaching said pawl from said tooth formation over a half of each of a number of said return strokes, said pegs or teeth being arranged in vertical rows and said patterning member having at least two adjacent equal vertical rows of said pegs or teeth to consecutively act on said jack selecting levers during a two-tooth advance movement of said tooth formation.

2. A device according to claim 1, wherein said first and second part slope to the outside of said annular cam in the direction of rotation thereof, and wherein said annular cam further comprises a part sloping to the inside of said annular cam in the direction of rotation thereof, said inside sloping part following said first and second part and extending substantially over a half circle and having an inclination substantially twice as great as the inclination of said first outside sloping part.

3. A device according to claim 1, wherein said support has a radial arm whereto is journalled one end of said cam follower lever, said cam follower lever having another end supporting an idle roller arranged to follow said peripheral profile of said annular cam, said cam follower lever being movable substantially radially to said at least one needle cylinder.

4. A device according to claim 1, wherein said means for detaching said pawl from said tooth formation over a half of each of a number of said return strokes comprise an angle lever journalled along an axis parallel to said axis of said patterning member, a number of control pegs arranged in a programmed manner along a horizontal row on said patterning member, said angle lever having one end for cooperation with said number of control pegs and another end having an outer guiding surface adapted for guiding a tip of said pawl during said half of each of said number of said return strokes, said angle lever being movable between a position whereat said first end engages none of said control pegs and said guiding surface is at a radially more external position with respect to said tooth formation and a position whereat said first end engages one of said control pegs and said guiding surface lies in a radially more internal position with respect to said tooth formation.

5. A device according to claim 1, further comprising a cup spring for braking said patterning member.

* * * * *